United States Patent [19]

Plumadore

[11] 4,392,734

[45] Jul. 12, 1983

[54] ELECTROPHOTOGRAPHIC CAMERA

[75] Inventor: John D. Plumadore, Westfield, Mass.

[73] Assignee: Photon Chroma, Inc., Westfield, Mass.

[21] Appl. No.: 144,782

[22] Filed: Apr. 28, 1980

[51] Int. Cl.[3] ..... G03G 15/10

[52] U.S. Cl. ..... 355/3 R; 354/3; 354/317; 355/10; 355/27

[58] Field of Search ..... 355/3 R, 10, 27; 354/3, 354/317, 324

[56] References Cited

U.S. PATENT DOCUMENTS

| | | | |
|---|---|---|---|
| 2,752,833 | 7/1956 | Jacob | 355/10 |
| 3,027,821 | 4/1962 | Wright | 354/317 X |
| 3,528,355 | 9/1970 | Blackert | 355/10 X |
| 3,672,763 | 6/1972 | Levene et al. | 355/27 X |
| 3,694,069 | 9/1972 | Yamaji et al. | 355/4 |
| 3,792,488 | 2/1974 | Katakabe | 355/10 X |
| 4,118,116 | 10/1978 | Koontz et al. | 355/3 R |
| 4,157,219 | 6/1979 | Ohta et al. | 355/10 |

*Primary Examiner*—Fred L. Braun
*Attorney, Agent, or Firm*—John J. Dempsey

[57] ABSTRACT

Camera for making slide transparencies on electrophotographic film which is carried during processing on one-half of a foldable, planar slide frame. The apparatus includes a reversible drive roll which automatically injects and ejects the frame carrying film for imaging and developing along the processing path of the camera. A corona unit for charging the photoconductive layer of the film is energized during inward movement of the film into the camera. After imaging by a light source, a liquid toner is activated for developing the image during withdrawal of the film along the processing path. The toner head includes spaced doctor blades for removal from the film of excess toner. The camera includes a fan which generates positive air pressure along the processing path during withdrawal of the film. Sensors are provided for processing elements including controlling an electric circuit for sequential operation of the drive roll, corona charging unit, toner pump and fan.

3 Claims, 7 Drawing Figures

Fig. 3.
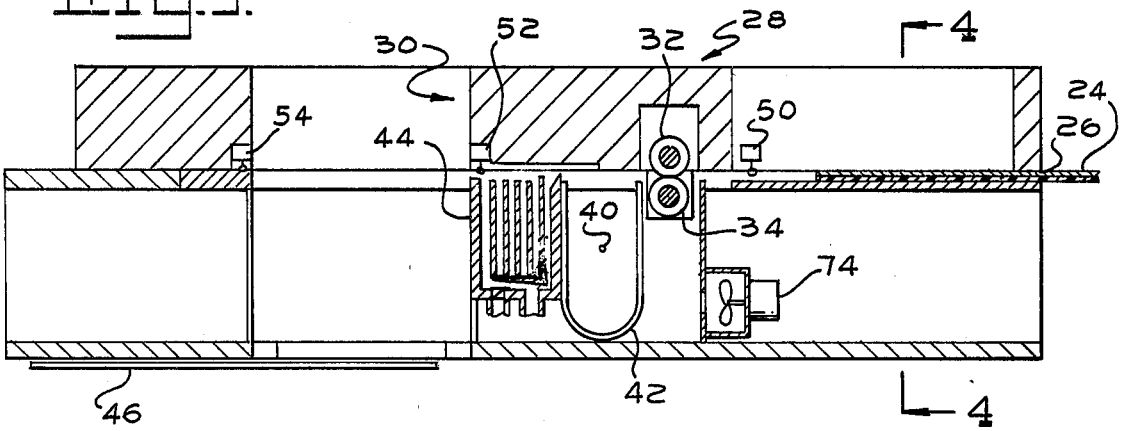
Fig. 4.
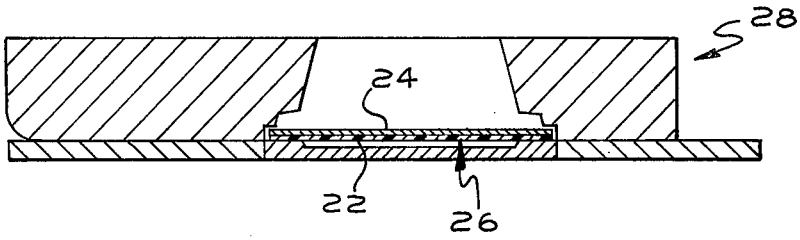
Fig. 5.
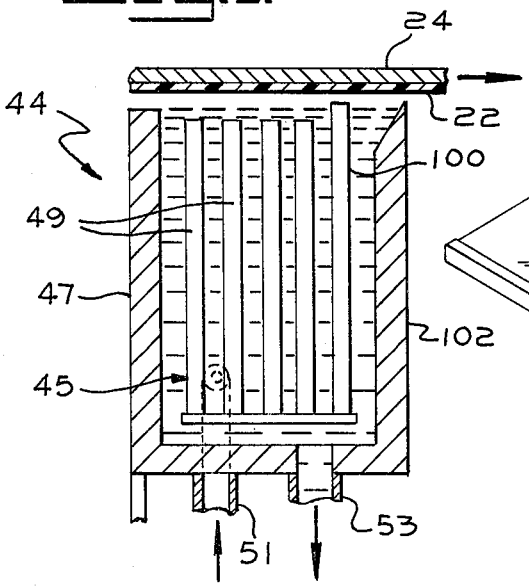
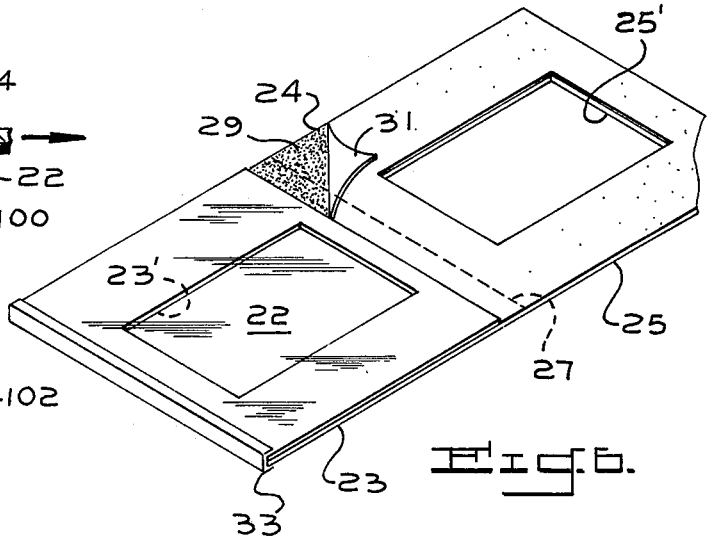
Fig. 6.

ELECTROPHOTOGRAPHIC CAMERA

BACKGROUND

In recent years, with the rapid expansion of visual communications, the use of slide transparencies has become increasingly popular. One of the most convenient techniques for visual presentation involves the use of 35 mm slide projectors which project slide transparencies on a screen for easy audience viewing. Such techniques are widely used in educational courses, and frequently during business, professional and governmental seminars. For maximum utilization of such slide transparencies, a simple and convenient procedure is needed for duplicating documents and other objects as projectable images on slide transparencies.

While silver halide and diazo film have been used in making such transparencies, the imaging and developing process for such films require the use of a darkroom or special equipment and, for best results, require trained operators. In contrast, electrophotography will produce excellent high-resolution images in a convenient and economical manner. At the present time, electrophotographic cameras are of limited availability and relatively expensive in price and not entirely satisfactory in performance. The only commercially available electrophotographic slide-processing system for making slide transparencies involves the use of fully mounted slide frames. Such frames consist of a film laminated between two rectangularly apertured frames. The plane of the film is recessed inwardly from the outer surface because of the thickness of the frames. In effect, the outer surface of the frame provides the processing surface plane of the camera. One such system is disclosed in the Yamaji patent, U.S. Pat. No. 3,694,069. In the use of these slides, imaging irregularities are sometimes encountered, particularly at the peripheral edges of the film adjacent the frame edge. This irregularity appears to be caused by the surface tension of the liquid toner which has a tendency to bridge over and not fully wet out the areas of the film adjacent the frame.

In the Yamaji camera, the fully mounted frame is provided with a hole to enable contact with the photoconductive layer of the film, and the frame moves through the apparatus in one direction. As a result, a relatively large processing block is required to provide a path or track of sufficient length for unidirectional movement of the film during processing. At various locations along the unidirectional processing path, the film is first charged by a corona charging unit, moved to an imaging location and, after imaging, advanced to still another site for developing. The development is carried out by the use of a rotatable, absorbent roll, which picks up toner from a bath and applies it to the film. Finally, the film is carried past fixing and drying stations.

The principal object of this invention is to provide an improved apparatus for automatically producing electrophotographic slide transparencies which apparatus is of compact size and economical to manufacture. The pre and post exposure processing of the film takes place on inverse, inextensive paths.

A further significant object of this invention is to provide an apparatus of above type wherein the film is automatically processed along a reciprocal path about half the length of the processing paths in commercially available electrophotographic cameras.

Another object of this invention is to provide an apparatus of the above type wherein the film being processed is disposed on one side of an open, foldable planar slide frame.

It is a further object of this invention to provide an apparatus of the above type wherein the open slide frame on which the film is carried is inserted and withdrawn along inverse processing paths by reversal of the same drive means and by automatic, sequential operation of the imaging and developing elements.

Yet another object of this invention is to provide an apparatus wherein positive air pressure is provided along a portion of the processing path during withdrawal of the imaged film.

Above and other objects and advantages of this invention will become more readily apparent from the following detailed description considered in view of the accompanying drawings wherein:

FIG. 3 is a sectional view taken along line 3—3 of FIG. 2;

FIG. 4 is a section taken along line 4—4 of FIG. 3;

FIG. 5 is an enlarged elevational view in cross section showing a toner head of the type utilized in this invention;

FIG. 6 is a perspective view of an open film-carrying slide frame of the type to be used in the apparatus embodying this invention.

DESCRIPTION OF THE PREFERRED EMBODIMENT

Figure 1:
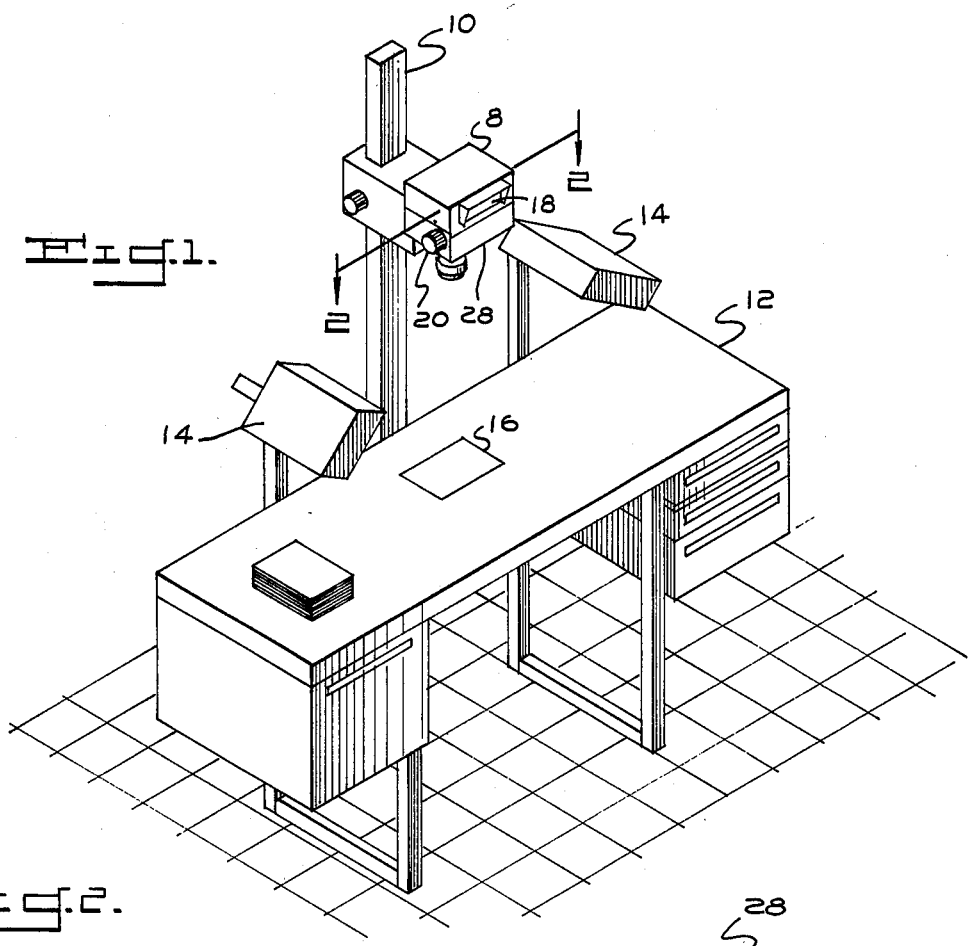
FIG. 1 is an overall perspective view showing an apparatus of the type embodying this invention.

Referring in detail to the drawings in FIG. 1 is shown an overall view of an electrophotographic camera embodying this invention. Preferably, the camera is adapted to produce convenient 35 mm slides available on a moment's notice for visual display using a conventional 35 mm slide projector (not shown). The camera or automatic slide processor 8 is mounted on a vertical post 10 for focusing movement of the camera toward and away from a document or other object 16 supported on a base or table 12. The illuminating means, such as lamps 14, are disposed to be directed toward the document which is to be duplicated in slide transparency form. The camera includes a view finder 18 for viewing the object being duplicated and a suitable focusing knob 20 for bringing the camera into sharp focus.

A slide transparency is shown generally at 24 in FIG. 6. This transparency comprises a paper or fiberboard foldable frame with two half portions 23 and 25 foldable about a score or crease line 27. Each half of the frame includes a rectangular cut-out or aperture 23' and 25'. A photographic film 22 is bonded to one side of the frame 23 while the other side is coated with a suitable pressure-sensitive adhesive 29 over which is removably disposed a release layer or paper 31. Metallic foil strip 33 is located about the outer edge of the frame 23. The strip 33 provides means for grounding the photoconductive layer during processing of the film. It will be noted, by reference to FIG. 6, that the frame 24 provides a generally planar surface defined by the film 22 on one half of the frame and the release paper 31 on the other half of the frame. This serves as a convenient processing surface for the film within the camera 8. After imaging and development of the film within the camera, a fully mounted slide is completed by simply peeling off the release paper and pressing the two slide halves together.

Slide transparencies used in the apparatus embodied in this invention may be of the same type as disclosed in my co-pending U.S. patent application, Ser. No. 6,053,901, filed July 2, 1979, now U.S. Pat. No. 4,249,328, and the disclosure of the aforesaid application is herein incorporated by reference.

Figure 2:
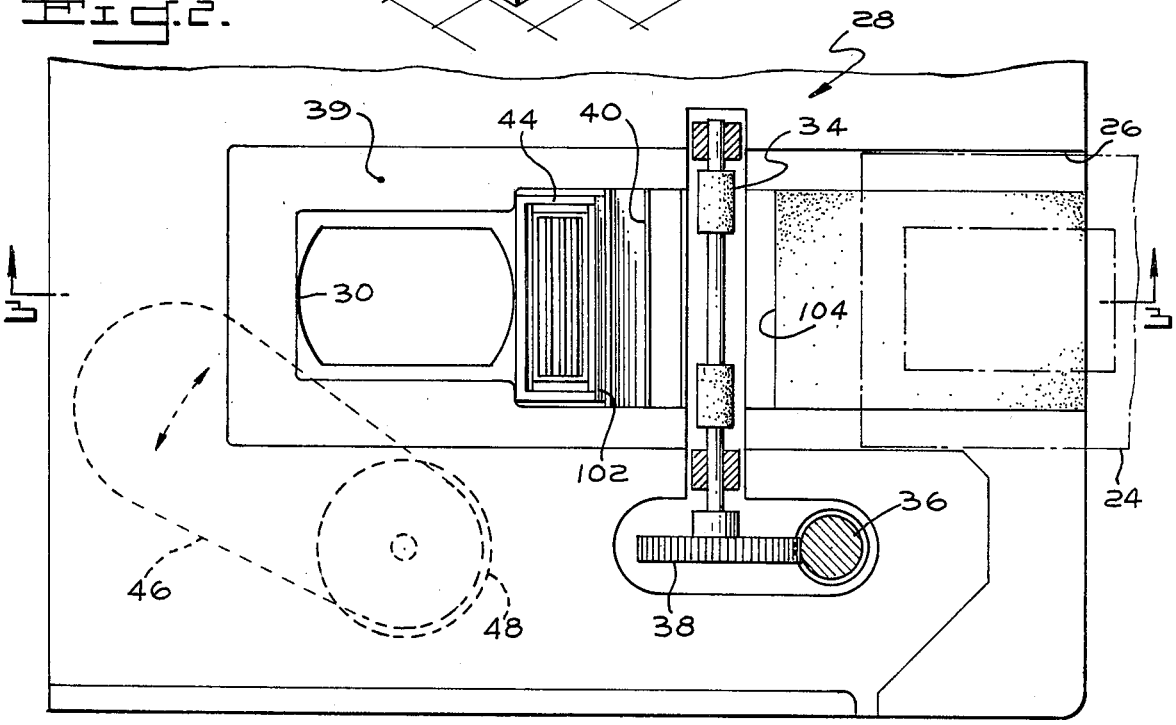
FIG. 2 is a sectional view, on an enlarged scale, taken along line 2—2 of FIG. 1.

Upon placing a document or other object to be copied on table 12, camera 8 is focused and an open slide frame 24, as shown in FIG. 6, is inserted into a slot 26 (FIGS. 2 and 3) located on one side of the camera 8. The frame 24 is inserted into the camera with side 23 disposed inwardly and with the film side down. The slide mounted film is slid into slot 26 in processing block 28 which forms the lower portion of a camera 8 and is best illustrated in FIGS. 2 and 3. The slide construction 24 permits the user to handle only the open half of the slide thereby reducing the chances of smudging the film with the fingers. This is true both when inserting and removing the frame because of the bidirectional processing track of the camera whereby the frame is ejected from the camera at the same location as it was inserted.

The processing block portion 28 of the camera is best illustrated in FIGS. 2 and 3. The block includes a film processing path or track of generally the same cross section as the inlet slot 26 and it extends from inlet slot 26 to the film exposure chamber 30 and back again. The film 22 is carried into and out of the camera by means of a pair of pinch rolls 32 and 34, the lower one being driven by an electrical drive motor 36 coupled to the roll 34 by suitable gearing 38. As shown in FIG. 2, a metallic insert or strip 39 is disposed along the marginal edges of the processing track. The metallic frame 39, which may be formed of brass or other suitable electrically conductive material serves to ground the film by contact with the metallic grounding strip 33 disposed about the leading edge of the frame 24 (FIG. 6).

Inwardly of the drive roll 34, means is providing for inducing an electrical charge on the conductive layer of the film, and, as shown, takes the form of a corona-charging unit 40 which includes an upwardly opening U-shaped shield 41 and a corona wire 43 connectable to a suitable voltage source. On its inward movement, the film next traverses a developing means in the form of a toner head 44 which is adapted to apply a developing liquid onto the film after it has been imaged in the camera. Thus, during inward passage of the film, the toner head is not activated. The toner head includes a reservoir 45 and is disposed within an upwardly opening rectangular housing 47. The reservoir consists of a plurality of plates 49 disposed in closely-spaced parallel relation disposed transversely of the path of movement of the film into and out of the camera. The toner liquid is controlled by a pump supply to reservoir 45 through a conduit or tube 51 and the outer housing 47 includes a drain tube 53 connected to a toner supply tank (not shown).

The innermost processing element of the camera 8 is the imaging chamber 30 having a shutter 46 operated by a solenoid 48 to selectively expose the film to imaging light reflected from the illuminated object 16.

Disposed at spaced location along the processing track are a number of sensing elements, such as microswitches 50, 52 and 54. Each of the switches is disposed at a location to be actuated by an edge of the slide frame 24 as it is advanced along the processing path or track of the camera. The switches are incorporated into a circuit to actuate various electrical controls including relays and motors to perform the film imaging and development sequentially on insertion and withdrawal of the film bearing slide frame.

It will be noted by reference to FIG. 3 that as the slide frame 24 is inserted into the slot 26, switch 50 will be the first one actuated resulting in drive motor 36 (FIG. 7) being energized to cause rotation of the drive roll 34. Thus, when the leading edge of the frame is inserted into the nip between the rolls 32 and 34, the frame 24 is thereafter drivingly engaged throughout its reciprocal travel along the processing path of the camera. The frame will be continuously moved into the camera for imaging and then retracted in the opposite direction along the same track for development of the image. Insertion and ejection of the slide frame thus takes place at the same location on the camera at the slot 26. Since the open side 25 of the frame 24 is always disposed outwardly, it provides for convenient handling and manipulation when inserting and withdrawing the slide with minimum likelihood of touching the film itself which could result in smudging of the image.

Figure 7:
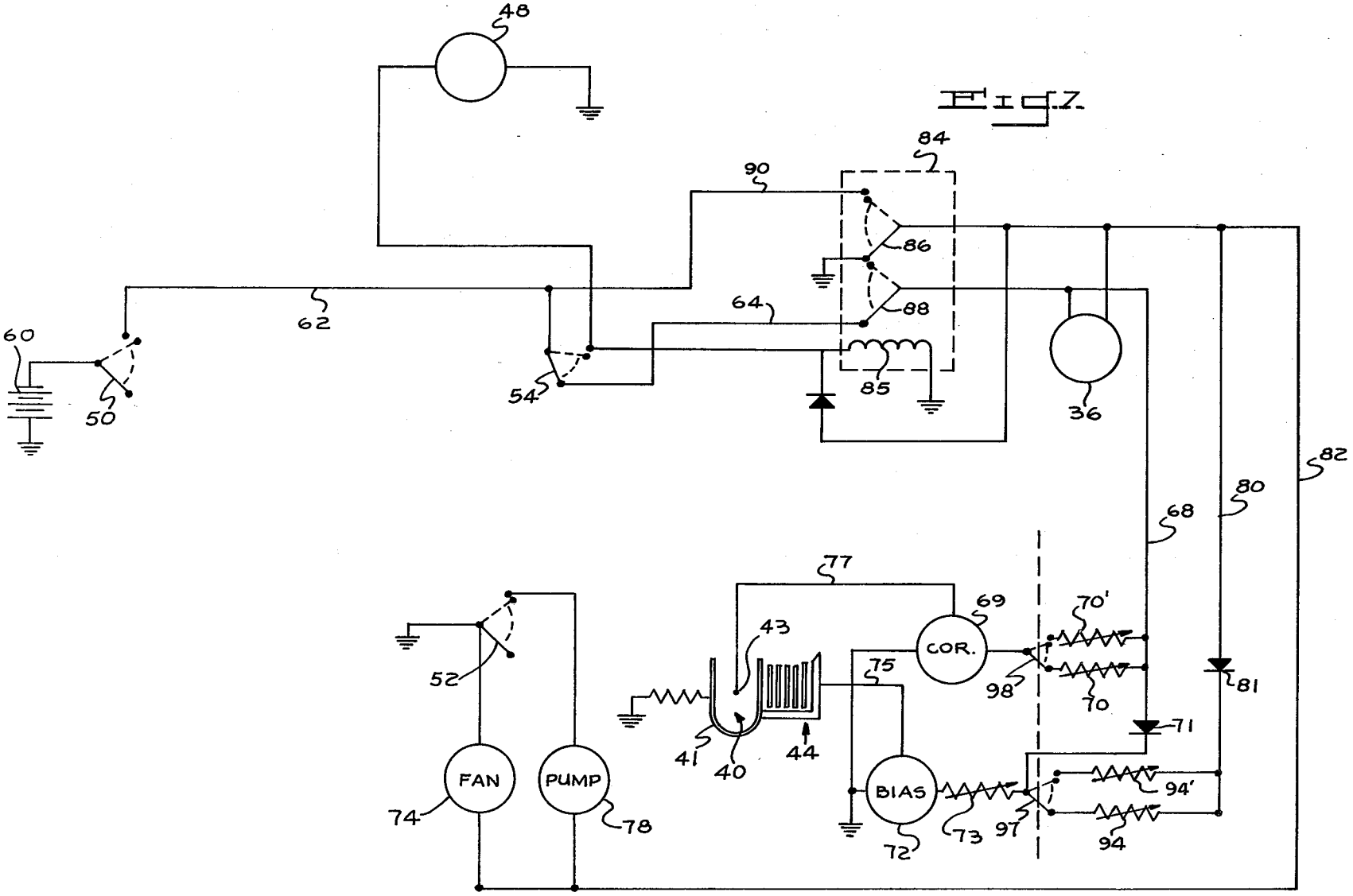
FIG. 7 is a schematic wiring diagram illustrative of a system used for controlling the operation of the film processing elements which constitute the apparatus of this invention.

When switch 50 is activated, as shown in FIG. 7, by moving it to its upper dotted line position power source 60 is connected by circuit leads 62 and 64 to drive motor 36. At this time, the switch 54 is in its down, solid-line position, as shown in FIG. 7. The connection of drive motor 36 causes the motor to rotate the roll in the direction to carry the frame 24 toward the imaging chamber 30. When the motor 36 is energized, power is also provided by circuit lead 68 for energizing a corona power supply 69 unit through a variable resistor 70 or 70′ depending upon the position of manually operable selector switch 98. A bias power supply unit 72 is also connected by lead 68 to the energy source 60, through diode 71 and variable resistor 73. Lead 75 connects the bias power supply to the metallic outer housing of the toner head 44 and lead 77 connects the corona power supply unit to the corona wire 43.

Under the control of the rolls 32 and 34, the frame 24 is advanced inwardly along the processing track of the camera and the film will be charged by the corona unit 40 as it traverses the same. The corona voltage may be on the order of about 5,000 volts. The outer wall 47 of the toner housing is also charged during this inward movement of the film by a bias voltage impressed thereon of about 1,200 volts. This bias voltage is about the same as the charge level which has been picked up by the film from the corona wire. As a result, the charge on the film remains stabilized in its passage over the toner head. The frame 24 continues its movement into the camera until its leading edge actuates the second limit switch 52 which in FIG. 3 is shown adjacent the inlet edge of the exposure chamber 30. When switch 52 is actuated, it is shifted to its upper position, as seen in FIG. 7, whereby the fan 74 and the pump 78 are now connected by lead 82 to time-delay relay 84, not at this time energized.

When the frame 24 is further carried to its imaging position, its leading edge will automatically contact the third limit switch 54 (FIGS. 3 and 7). When switch 54 is moved from its solid-line position, as seen in FIG. 7, to its upper dotted line position, the power source 60 is then connected to energize shutter solenoid 48 which operates the shutter 46 for imaging the film. Coil 85 of time-delay relay 84 is also energized at this time and after a delay of approximately 7 seconds, relay 84 operates switches 86 and 88 of the double throw-double pole type to be shifted from their solid-line positions shown in FIG. 7 to the dotted-line position. Connection of the energy source to the motor 36 is thereby reversed, the power source 60 being connected to the motor 36 by means of leads 62, 90 and switch 86, and to the motor ground connection by switch 88. This reversal in the power supply to motor 36 causes it to drive in the reverse direction so that the slide frame 24 will not be extracted from the exposure chamber by drive roll 34. Upon actuation of the switches of the time-delay relay, leads 80 and 82 are also energized. In circuit with lead 80 is a diode 81 whereby electrical power is connected through either resistor 94 or 94' and resistor 73 to the bias power supply 72. Manually operable switch 97 is provided for selection of either of the variable resistors 94 or 96 depending upon the voltage desired to be applied to the bias power source 72. In addition, upon actuation of the time-delay relay 84, lead 82 connects the power supply to the fan 74 and the pump 78 which are thereupon energized during withdrawal of the film from its imaging position. The pump 78 supplies toner liquid through the conduit 51 (FIG. 5) into the toner head. The toner liquid under pressure flows over the upper edges of the plates 49 and due to its liquid pressure, capillary action and the surface tension thereof, the toner is applied to the charged photoconductive areas of the imaged film 22. The overflow toner liquid is collected in the outer housing 47 and is returned by way of conduit 53 to a toner supply tank.

A double doctor blade arrangement is provided by the upper edge of plate 100 and wall 102 of the toner housing 47. These vertical walls are dimensioned so that these upper edges are spaced about 0.010 inch from the surface of film 22 being carried thereover. With this spacing, the upper edge surfaces of these walls are adapted to "doctor-off" any surplus toner liquid. The upper edge of wall 102 is, as shown, preferably beveled for cooperation with the flow of air illustrated in FIG. 6 which is created within the processing block by operation of the fan or blower 74. The fan is connected to the block in any convenient manner so that a positive air pressure will prevail over the entire area of the film in its withdrawal transit from the upper edge of the wall 102 to the horizontal edge 104 of the processing track, as seen in FIG. 2. This positive air pressure acting along the upper edge of the wall 102 further insures against any toner liquid overflowing the toner head, beveled edge 102 thus acting as an air knife. In addition, the positive pressure with the processing block tends to support the film on a cushion of air and thereby prevents the film contacting the underlying processing surfaces as may occur where such positive pressure is not utilized. Moreover, the air causes a rapid and uniform drying of the toning liquid on the film during its withdrawal from the camera.

During withdrawal of the film after imaging and during its development, a bias voltage lower than the pre-exposure bias voltage is impressed upon the metallic housing 47 surrounding the toner head. This voltage during film withdrawal is preferably in the order of 600 volts while upon insertion of the film before imaging, the bias was on the order of about 1,200 volts. With this arrangement, the walls of the housing 47 serve as biasing electrodes having a pre-exposure voltage during insertion of the film and a development bias during ejection of the imaged film. The reason for applying these two different bias voltages to the toner head is to approximately equalize the voltage which is impressed on the photoconductive layer of the film. The film carried by the frame 24 continues to be extracted from the camera under the control of the rolls 32 and 34 until its outer end 25 is presented at the slot 26 for withdrawal from the camera. When the user withdraws the frame, the camera will be automatically deenergized by switch 50 shifting to its open position. The completed slide 24 may then be completed by simply pulling off the release paper 31 and folding the two halves of the frame together. The slide is now ready for projection using a standard 35 mm slide projector.

Having thus described my invention, what is claimed is:

1. Camera for making frame-mounted slide transparencies adapted for projection in a slide projector using electrophotographic film carried on a foldable, planar slide frame, said camera comprising reversible drive means for carrying the frame-mounted film into and out of said camera along a processing track for a single imaging cycle, including an imaging path and a development path, which are co-extensive, but in opposite directions, said imaging path including a corona unit for electrically charging said film while the film is moving thereby and including a corona wire disposed transversely to the path of movement of the film, and an exposure chamber spaced along said imaging path from the corona unit for the imaging of said film, said development path including a toner head disposed between the corona unit and exposure chamber, a means for controlling the operation of said drive means to carry the frame-mounted film toward said exposure chamber into registry therewith and for reversing the direction of drive means to withdraw the imaged film along said development path, means for supplying liquid toner to the toner head for developing the imaged film and means for supplying positive air pressure being directed to impinge against the toned surface of the film, said control means including means for sensing positions of the frame during its movement along said track and for selectively energizing the corona unit before imaging and then the toner supply means and air supply means during development of the film after imaging, a bias electrode disposed adjacent said toner head and means for biasing said electrode to a first voltage during pre-exposure passage of said film thereby and to a second substantially lower voltage during passage of said film thereby after exposure within the camera.

2. Camera for making slide transparencies as set forth in claim 1 in which said electrode forms a portion of the toner head whereby the first bias voltage is impressed thereon before imaging of the film and the second bias voltage is impressed thereon along generally the same portion of the development path as the toning of the film occurs.

3. Camera for making frame-mounted slide transparencies adapted for projection in a slide projector using electrophotographic film carried on a foldable, planar slide frame, said camera comprising reversible drive means for carrying the frame-mounted film into and out of said camera along a processing track for a single imaging cycle, including an imaging path and a development path, which are co-extensive, but in opposite directions, said imaging path including a corona unit for electrically charging said film while the film is moving thereby and including a corona wire disposed transversely to the path of movement of the film, and an exposure chamber spaced along said imaging path from the corona unit for the imaging of said film, said development path including a toner head disposed between the corona unit and exposure chamber, a means for controlling the operation of said drive means to carry the frame-mounted film toward said exposure chamber into registry therewith and for reversing the direction of drive means to withdraw the imaged film along said development path, means for supplying liquid toner to the toner head for developing the imaged film and means for supplying positive air pressure being directed to impinge against the toned surface of the film, said control means including means for sensing positions of the frame during its movement along said track and for selectively energizing the corona unit before imaging and then the toner supply means and air supply means during development of the film after imaging, said processing track of said camera having an electrically conductive strip disposed along the marginal edges thereof for the grounding of said film, said foldable frame including conductive metal foil disposed along the edge portion of the film for contact with said conductive strip in the camera.

* * * * *